US010689982B2

(12) United States Patent
Soeguet et al.

(10) Patent No.: US 10,689,982 B2
(45) Date of Patent: Jun. 23, 2020

(54) IMPELLER FOR AN EXHAUST GAS TURBOCHARGER

(71) Applicant: Bosch Mahle Turbo Systems GmbH & Co. KG, Stuttgart (DE)

(72) Inventors: Senol Soeguet, Renningen (DE); Felix Scheerer, Schorndorf (DE); Martin Kuhn, Stuttgart (DE)

(73) Assignee: BMTS TECHNOLOGY GMBH & CO. KG (DE)

( * ) Notice: Subject to any disclaimer, the term of this patent is extended or adjusted under 35 U.S.C. 154(b) by 740 days.

(21) Appl. No.: 15/227,933

(22) Filed: Aug. 3, 2016

(65) Prior Publication Data

US 2017/0037729 A1 Feb. 9, 2017

(30) Foreign Application Priority Data

Aug. 4, 2015 (DE) ..... 10 2015 214 854

(51) Int. Cl.

*F01D 5/04* (2006.01)
*F01D 5/14* (2006.01)
*F04D 29/28* (2006.01)

(52) U.S. Cl.

CPC ..... *F01D 5/04* (2013.01); *F01D 5/141* (2013.01); *F04D 29/284* (2013.01); *F05D 2220/40* (2013.01); *F05D 2240/80* (2013.01); *F05D 2250/18* (2013.01); *F05D 2250/183* (2013.01); *F05D 2250/184* (2013.01); *F05D 2250/611* (2013.01); *F05D 2250/73* (2013.01)

(58) Field of Classification Search

CPC ..... F01D 5/04; F01D 5/141; F01D 5/143
See application file for complete search history.

(56) References Cited

U.S. PATENT DOCUMENTS 2,918,254 A * 12/1959 Hausammann ..... F01D 5/021 415/116
5,215,439 A 6/1993 Jansen et al.
8,721,287 B2 5/2014 Billotey et al.
9,404,506 B2 * 8/2016 Masutani ..... F04D 29/30
(Continued)

FOREIGN PATENT DOCUMENTS

CN 104508245 A 4/2015
DE 102012106810 A1 1/2014
(Continued)

OTHER PUBLICATIONS

Extended European Search Report for EP Application No. 16181125.2 dated Jan. 4, 2017.
(Continued)

*Primary Examiner* — Igor Kershteyn
*Assistant Examiner* — Brian O Peters
(74) *Attorney, Agent, or Firm* — Fishman Stewart PLLC

(57) ABSTRACT

An impeller for an exhaust gas turbocharger may include a hub main body and blades arranged thereon. The hub main body may be configured as a polygon with a number of segments that may be tilted with respect to one another, the number of the segments corresponding to a number of the blades. Alternatively, the hub main body may have a main surface that faces the blades and undulates in a circumferential direction, a number of the undulations corresponding to the number of the blades.

10 Claims, 2 Drawing Sheets

(56) References Cited

U.S. PATENT DOCUMENTS

| | | | | |
|---|---|---|---|---|
| 2012/0100003 | A1* | 4/2012 | Masutani | F04D 29/68 416/235 |
| 2012/0269636 | A1 | 10/2012 | Xu | |
| 2012/0282085 | A1* | 11/2012 | Bajeet | F04D 29/2288 415/196 |
| 2015/0125302 | A1 | 5/2015 | Roberto et al. | |

FOREIGN PATENT DOCUMENTS

| | | | |
|---|---|---|---|
| FR | 1002707A | A | 3/1952 |
| JP | 2002161702 | A | 6/2002 |
| JP | 2008163760 | A | 7/2008 |
| WO | 2014/015959 | A1 | 1/2014 |

OTHER PUBLICATIONS

English abstract for JP-2008163760.
English abstract for JP-2002161702.
German Search Report for DE-102015214854.8, dated Jun. 6, 2016.
Chinese Office Action for Chinese Patent Application No. 201610622313.X, dated Mar. 5, 2019.
English Abstract for CN-104508245-A.

* cited by examiner

IMPELLER FOR AN EXHAUST GAS TURBOCHARGER

CROSS-REFERENCE TO RELATED APPLICATIONS

This application claims priority to German Patent Application No. 10 2015 214 854.8, filed Aug. 4, 2015, the contents of which are hereby incorporated by reference in its entirety.

TECHNICAL FIELD

The present invention relates to an impeller for an exhaust gas turbocharger having a hub main body and blades which are arranged thereon. Moreover, the invention relates to an exhaust gas turbocharger having an impeller of this type.

BACKGROUND

U.S. Pat. No. 8,721,287 B2 has disclosed an impeller of the generic type for an exhaust gas turbocharger having a hub main body and blades which are arranged thereon. In order for it to be possible here to reduce the load, in particular in an attachment region of the blades to the hub main body, a transition between the hub main body and the blades is rounded in the manner of an ellipse.

In general, impellers consist of a hub main body and the blades which are arranged thereon, modern impellers usually being equipped for thermodynamic reasons with a backward curved impeller outlet. Under the influence of the centrifugal force on a suction side in the attachment region of the blades to the hub main body, said backward curvature leads to high tensile stresses which reduce the expected service life. A higher rotational speed and/or an even more pronounced backward curvature are/is possible only to a restricted extent, however, for reasons of the service life. Moreover, the hub main bodies which are usually used nowadays are configured as continuously round rotational bodies, this simple geometry not being ideal with regard to the load which occurs particularly at a transition between the blade and the hub main body. This can also be remedied here only to a limited extent by way of an increase in a radius at the transition between the blade and the hub main body, since the highest load often does not occur at the transition itself, but rather in the hub main body at the end of the transition.

SUMMARY

The present invention is therefore concerned with the problem of configuring an impeller in such a way that it is firstly of weight-optimized configuration and secondly is of optimized configuration with regard to absorbing possible loads.

According to the invention, this problem is solved by way of the subject matter of the independent claims. Advantageous embodiments are the subject matter of the dependent claims.

The present invention is based on the general concept of now modifying a hub main body, configured up to now as a round rotational body, of an impeller for an exhaust gas turbocharger in such a way with regard to its design that, in particular, load regions which have been critical up to now, for example at a transition between the hub main body and blades which are arranged thereon, can be relieved effectively, without it being necessary for the impeller per se to be of considerably more solid and therefore heavier configuration. As an alternative, two embodiments are available for selection to this end, the hub main body being configured as a polygon with a number of segments which are tilted with respect to one another, which number corresponds to the number of blades, in the first embodiment, and, as an alternative, the hub main body having a main surface which faces the blades and undulates in the circumferential direction, a number of the undulations in this case corresponding to a number of the blades. A common feature here of both embodiments is that the hub main body is modified, in particular, in the region of the transition to a blade in such a way that it is capable of absorbing the stresses which occur there in an improved manner, in particular tensile stresses on account of a backward curvature of the individual blades, as a result of which not only the performance, but rather additionally also the service life of an impeller of this type, can be increased.

According to one advantageous development of the impeller according to the invention in accordance with the first alternative, the individual segments have a main surface of straight cross section radially on the outside. In this case, therefore, the hub main body is configured as a polygon with a number of segments which corresponds to the number of individual blades, the said segments in each case having a straight main surface and merging into one another in a sawtooth-like manner radially on the outside. In particular, the stress-critical region at the transition between the main surface of the hub main body and the associated blade can be optimized with regard to the stresses which occur there by way of the said straight main surface of the segments according to the invention which are arranged such that they are tilted with respect to one another.

In a further advantageous embodiment of the solution according to the invention in accordance with the first alternative, a transition from a segment into an associated blade is rounded. As a result, in particular, kinks and therefore stress intensifiers can be avoided, as a result of which further optimization with regard to the stresses which occur can be achieved.

In a further advantageous embodiment of the solution according to the invention, the rounded transition is formed by way of a material addition to the main surface of the respective segment. Therefore, in each case one slight material accumulation is provided in the transition region, which material accumulation is sufficient to absorb the increased stresses which occur there, represents only a local material application, however, in comparison to a completely reinforced hub main body, and makes the impeller according to the invention considerably lighter as a result.

In one advantageous development of the impeller according to the invention in accordance with the second alternative, a transition from the main surface into an associated blade is arranged in the region of an undulation peak. As a result, a particularly flowing and therefore notch-free transition can be achieved between the hub main body or its main surface into the associated blade, the said transition into the main surface being formed, for example, by way of a tangent which is applied to an undulation slope. As a result of a tangent of this type, no kink at all is produced in this region of the transition into the main surface, and therefore also no stress intensifier at all. In addition, it can be provided that the transition is rounded and, as a result, also merges into the respectively associated blade in a stepless and/or unkinked manner, with the result that stress intensifiers can also be avoided in this region.

According to a further advantageous embodiment of the impeller according to the invention, the hub main body has a back which undulates in the circumferential direction. Here, a number of undulations on the back of the hub main body can correspond to a number of blades on the opposite front side. This affords the particular advantage that the main surface or the hub main body can be stiffened by way of the undulating shape and at the same time can be of material-optimized configuration with regard to the stresses which occur. Locally occurring stresses which usually occur on the impeller back below the blades can be dissipated by way of the undulating back of the hub main body. The advantage of an undulating impeller back is the local material application at highly loaded locations. This makes a dissipation of the stresses which is effective in relation to the mass possible, without an unnecessary increase in weight.

Furthermore, the present invention is based on the general concept of equipping an exhaust gas turbocharger with an abovementioned impeller of this type, it being possible for a considerably improved response behaviour of the exhaust gas turbocharger to be achieved by way of the impeller according to the invention which is considerably lighter on account of the merely low local material application than impellers which have previously been thickened completely. In addition, the service life of the entire exhaust gas turbocharger can also be extended, since cracking of the impeller and therefore damage of a compressor housing need not be feared as a result of the extension of the service life of the said impeller.

In an advantageous refinement of the second alternative embodiment of the impeller according to the invention, the undulation peaks taper off in a radially inward and/or radially outward direction and transition into the main surface in a flush manner, such that no undulation peaks are present at an impeller inlet and at an impeller outlet. Thus, undulations or undulation peaks are arranged only at locations at which they are actually required owing to the occurring loads. In this way, it is possible to realize a load-optimized and simultaneously weight-optimized impeller.

It is expediently the case that, for a ratio of a radius RVR of the impeller with respect to a maximum radial extent RWB of the undulation peak, the following applies:
$1.1<RVR/RWB<2.2$.

In particular, by way of the radial delimitation of the arrangement of the undulation peaks and its characteristic whereby it is rotationally asymmetrical and returns to the original, rotationally symmetrical hub profile again both in the direction of the impeller inlet and in the direction of the impeller outlet, thermodynamic disadvantages can be avoided.

Further important features and advantages of the invention arise from the subclaims, from the drawings and from the associated description of the figures using the drawings.

It goes without saying that the features which are mentioned in the above text and those which are still to be explained in the following text can be used not only in the respectively specified combination, but rather also in other combinations or on their own, without departing from the scope of the present invention.

Preferred exemplary embodiments of the invention are shown in the drawings and will be explained in greater detail in the following description, identical reference numerals referring to identical or similar or functionally identical components.

BRIEF DESCRIPTION OF THE DRAWINGS

In the drawings, in each case diagrammatically.

DETAILED DESCRIPTION

Figure 1:
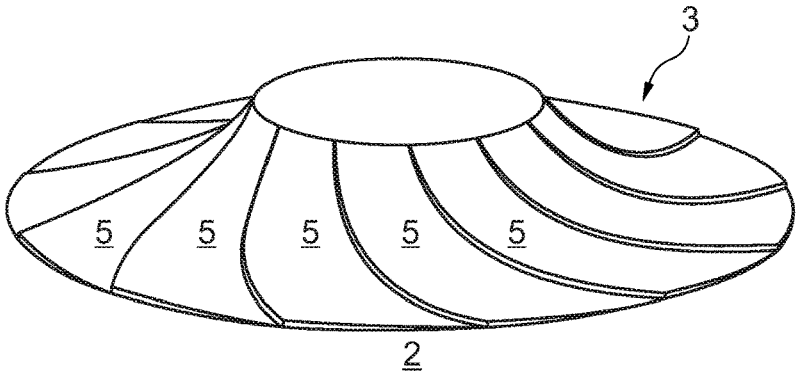
FIG. 1 shows a view of a hub main body of an impeller according to the invention in accordance with a first embodiment.

According to FIGS. 1-5, an impeller 1 according to the invention for an exhaust gas turbocharger 2 has a hub main body 3 and blades 4 which are arranged thereon. FIG. 1 shows merely the hub main body 3, but not the associated blades 4. In order for it then to be possible to optimize the impeller 1 according to the invention with regard to a stress which occurs in the region of a transition 7 between the respective blade 4 and the hub main body 3, two alternative embodiments of the hub main body 3 are provided, a first alternative being shown in FIGS. 1 and 2 and the second alternative being shown in FIGS. 3 to 5.

Figure 2:
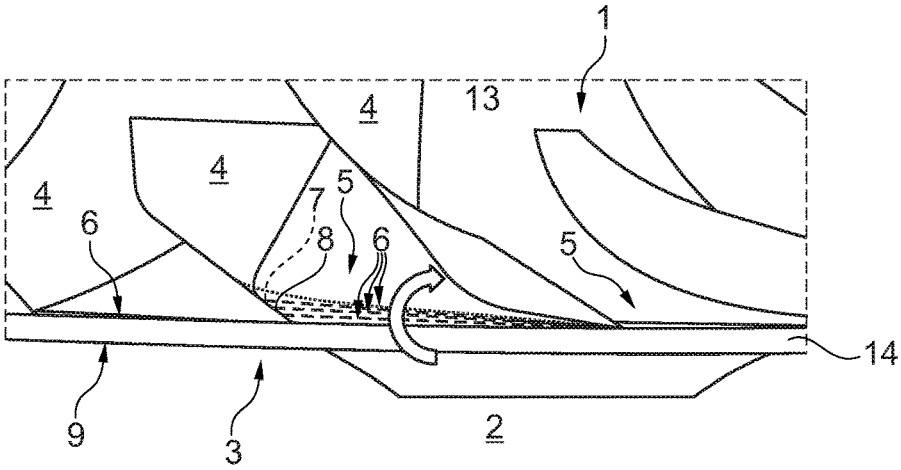
FIG. 2 shows a side view of an impeller according to the invention in accordance with the first embodiment.

According to FIGS. 1 and 2, the hub main body 3 is configured here according to the invention as a polygon with a number of segments 5 which are tilted with respect to one another, which number corresponds to the number of blades 4. Here, the individual segments 5 (cf. also FIG. 2) preferably have a main surface 6 of straight cross section at least radially on the outside, which segments 5, depending on requirements, can be tilted to a different extent with respect to the hub main body 3 or the respective blade 4 and also with respect to one another. Here, the transition 7 from a segment 5 into an associated blade 4 is preferably rounded, the rounded portion or the rounded transition 7 being formed by way of a material addition 8, that is to say an additional material application, to the main surface 6 of the respective segment 5.

In comparison to hub main bodies which are known from the prior art and in which they had been configured exclusively as a round rotational body, the hub main body 3 according to the invention and therefore also the impeller 1 according to the invention affords the great advantage that the said impeller 1 is reinforced exclusively locally in that region, in which the stresses which occur during operation of the exhaust gas turbocharger 2 are the highest. Moreover, a notch-free transition both into the main surface 6 of the segment 5 and into the associated blade 4 can be achieved by way of the rounded portion, as a result of which stress peaks can be avoided.

Figure 3:
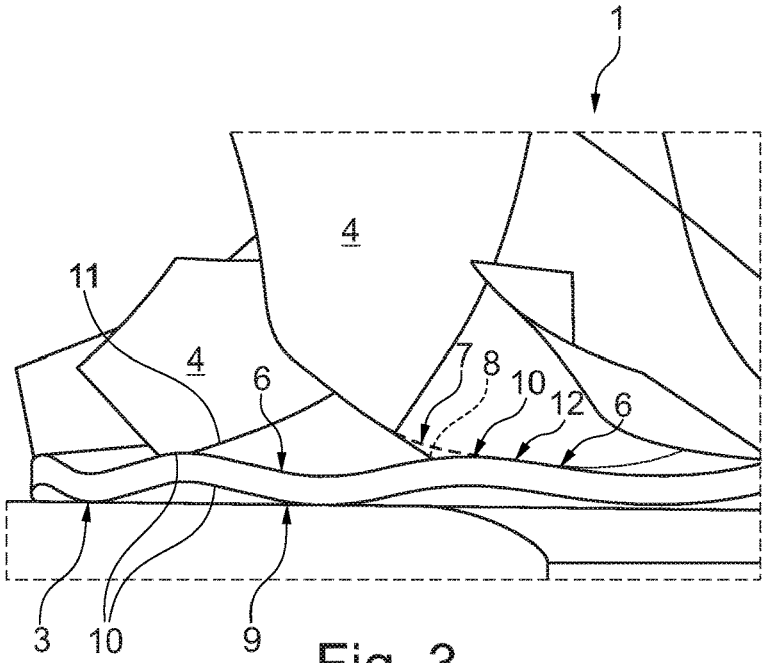
FIG. 3 shows a side view of an impeller according to the invention in accordance with a second embodiment.

If the impeller 1 according to the invention in accordance with the second alternative embodiment in FIG. 3 is considered, it can be seen that the hub main body 3 here has a main surface 6 which faces the blades and undulates in the circumferential direction, a number of the individual undulations 10 corresponding to a number of the blades 4. In addition, in this case, a back of the main surface 6 or the hub main body 3 is also of undulating configuration, the undulations 10 of the back 9 and the main surface 6 running in parallel. It goes without saying that the back 9 can also be configured here without undulations of this type, that is to say can be of straight configuration, it also being possible in this context for the back 9 on the hub main body 3 of the impeller 1 according to FIGS. 1 and 2 to be of straight configuration or else configured with undulations 10. Here, a transition 7 from the main surface 6 into an associated blade 4 is preferably arranged in the region of an undulation peak 11 or at least slightly next to it. It can be provided, moreover, that a transition 7 between the undulating main surface 6 and the associated blade 4 is rounded, as shown according to FIG. 3 by way of an interrupted line, a rounded transition 7 of this type merging into the main surface 6 by way of a tangent which is applied to an undulation slope 12. In a similar way, a tangential transition into the associated blade 4 can also be achieved.

In both embodiments which are shown and are alternative but nevertheless are equivalent in relation to the stress and weight optimization, a common feature here is that they are capable of absorbing, in particular, the high stresses which occur in the region of a transition 7 from a main surface 6 of the hub main body 3 into the associated blade 4 in an improved manner by way of a special configuration or dimensional change of the hub main body 3, which has previously not existed, and of ensuring a longer service life as a result. In comparison with hub main bodies which are thickened completely, that is to say at all locations, it goes without saying that a hub main body 3 of this type according to the invention which is reinforced merely locally is considerably lighter and, as a result, has a reduced mass moment of inertia, as a result of which an exhaust gas turbocharger 2 which is equipped with the said impeller 1 exhibits an improved response behaviour.

Figure 4:
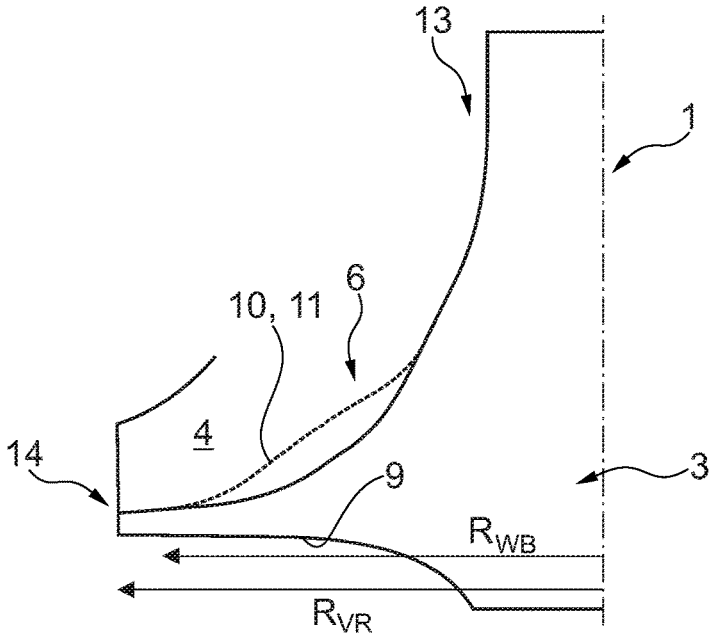
FIG. 4 shows a cross section through an impeller according to the invention in accordance with a variant of the second embodiment.
Figure 5:
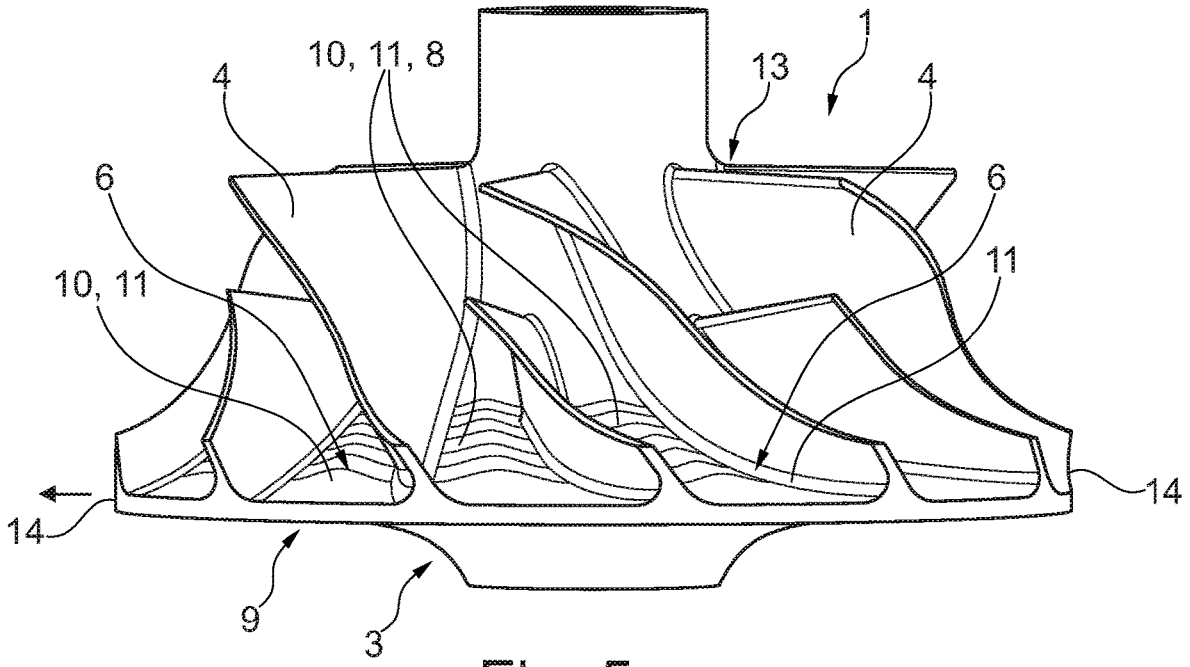
FIG. 5 shows a side view of an impeller in accordance with FIG. 4.

In the conventional manner, it is the case here that all of the embodiments as per FIGS. 3 to 5 have in common the fact that the undulation peaks 11 are arranged in each case between two blades 4.

Considering the impeller 1 as per FIG. 4, it can be seen that the undulation peaks 11 taper off in a radially inward and/or radially outward direction and transition into the main surface 6, such that no undulation peaks 11 are present at an impeller inlet 13 and at an impeller outlet 14. Here, in FIG. 4, the original profile of an impeller according to the prior art is shown by way of a solid line, whereas the profile of the impeller 1 according to the invention in the region of the undulation peak 11 is shown by a dotted line. In the case of an impeller 1 as per FIGS. 4 and 5, the hub main body 3 has a planar back 9.

Here, the radial position of the undulation peaks 11 may be formed, in relation to the impeller size (impeller radius), from the quotient "impeller radius/undulation peak position". Here, it has been found that the ratio of the undulation peak 11 to the radius RVR of the impeller 1 lies between 1.1 and 2.2. For a ratio of a radius RVR of the impeller 1 to a maximum radial extent RWB of the undulation peak 11, the following therefore applies:

$1.1 < RVR/RWB < 2.2$.

The thickening, in particular additional material portions 8, of the undulation peaks 11 is thus present only in the intermediate region between two adjacent blades 4. The appearance of the profile changes depending on where the most highly loaded region is. However, all of the profiles have in common the fact that they are rotationally asymmetrical and return to the original, rotationally symmetrical hub profile again both in the direction of the impeller inlet 13 and in the direction of the impeller outlet 14. In this way, thermodynamic disadvantages can be avoided.

The invention claimed is:

1. An impeller for an exhaust gas turbocharger, comprising:

a hub main body and blades arranged thereon;

wherein the hub main body is configured as a polygon with a number of segments that are tilted with respect to one another in relation to a circumferential direction, the number of the segments corresponding to a number of the blades; and wherein each of the number of segments extends and increases in thickness from one blade to an adjacent blade in a rotation direction of the impeller and has a main surface with a straight contour, a thick side of each of the number of segments merging into a thin side of an adjacent segment to form a sawtooth configuration of a hub surface.

2. The impeller according to claim 1, wherein a transition from a segment into an associated blade is rounded.

3. The impeller according to claim 2, wherein the rounded transition is formed by way of a material addition to the main surface of the respective segment.

4. The impeller according to claim 1, wherein the hub main body has a back that undulates in the circumferential direction.

5. An exhaust gas turbocharger comprising an impeller having a hub main body and blades arranged thereon;

wherein the hub main body is configured as a polygon with a number of segments that are tilted with respect to one another in relation to a circumferential direction, the number of the segments corresponding to a number of the blades; and wherein each of the number of segments extends and increases in thickness from one blade to an adjacent blade in a rotation direction of the impeller and has a main surface with a straight contour, a thick side of each of the number of segments merging into a thin side of an adjacent segment to form a sawtooth configuration of a hub surface.

6. The exhaust gas turbocharger according to claim 5, wherein a transition from a segment into an associated blade is rounded.

7. The exhaust gas turbocharger according to claim 6, wherein the rounded transition is formed by way of a material addition to the main surface of the respective segment.

8. The impeller according to claim 1, wherein at least a subset of the segments are tilted to a different extent with respect to at least one of the hub main body, the respective blade, and one another.

9. The exhaust gas turbocharger according to claim 5, wherein at least a subset of the segments are tilted to a different extent with respect to at least one of the hub main body, the respective blade, and one another.

10. The exhaust gas turbocharger according to claim 5, wherein each segment decreases in thickness from one radial end toward an adjacent segment to form a sawtooth configuration.

* * * * *